United States Patent [19]

Ueda

[11] Patent Number: 4,865,203

[45] Date of Patent: Sep. 12, 1989

[54] SEALED PAPER CONTAINER

[75] Inventor: Kazuo Ueda, Tokushima, Japan

[73] Assignee: Shikoku Kakoki Co., Ltd., Tokushima, Japan

[21] Appl. No.: 152,795

[22] Filed: Feb. 5, 1988

[30] Foreign Application Priority Data

Feb. 7, 1987 [JP] Japan ..... 62-16840

[51] Int. Cl.[4] ..... B65D 3/26

[52] U.S. Cl. ..... 206/606; 206/607; 206/608

[58] Field of Search ..... 206/606, 607, 608, 605, 206/611, 612, 613

[56] References Cited

U.S. PATENT DOCUMENTS

| | | | |
|---|---|---|---|
| 2,836,343 | 5/1958 | Will | 206/607 |
| 3,387,736 | 6/1968 | Williamson | 206/607 |
| 4,380,289 | 4/1983 | Bigelow | 206/606 |
| 4,606,462 | 8/1986 | Bogren | 206/606 |

*Primary Examiner*—Joseph Man-Fu Moy

*Attorney, Agent, or Firm*—Armstong, Nikaido, Marmelstein, Kubovcik & Murray

[57] ABSTRACT

A sealed paper container filled with contents has a trunk of square to rectangular cross section. The trunk has a horizontal breakable portion formed in its three side walls close to their upper ends and removable by tearing by hand. The remaining side wall is provided at the same level as the breakable portion with a portion for forming a joint between the container body and the closure to be formed by removing the breakable portion. The breakable portion and the joint forming portion serve as a boundary to provide a closure forming portion thereabove and a container body forming portion therebelow. The container body forming portion has an engaging member secured to the inner side of its upper end, extending along the three side walls and projecting upward therefrom for engaging the closure to be formed by removing the breakable portion. The upward projection of the engaging member extends along the lower end of the closure forming portion on the inner side thereof.

3 Claims, 2 Drawing Sheets

SEALED PAPER CONTAINER

BACKGROUND OF THE INVENTION

The present invention relates to a sealed container made of paper, and more particularly to a sealed paper container which is serviceable as a container having a closure.

Sealed paper containers filled with milk, juice, coffee or the like have heretofore been widely used because they can be prepared automatically, inexpensively and efficiently and further because they are made of paper and can therefore be compressed into a compacted form after use.

However, containers of this type are used only for liquid contents since the sealed container merely has a spout forming portion which can be readily opened, such that ice cream or paste, even if filled in the container, can not be taken out.

SUMMARY OF THE INVENTION

The main object of the present invention is to provide a sealed paper container from which the contents, even if other than a liquid, can be taken out through an opening, which can be closed again after the contents have been partially taken out.

The invention provides a sealed paper container filled with contents and having a trunk of square to rectangular cross section, the trunk having a horizontal breakable portion formed in its three side walls close to their upper ends and removable by tearing by hand, the remaining side wall of the trunk being provided at the same level as the breakable portion with a portion for forming a joint between the container body and the closure to be formed by the removal of the breakable portion, the breakable portion and the joint forming portion serving as a boundary to provide a closure forming portion thereabove and a container body forming portion therebelow, the container body forming portion having an engaging member secured to the inner side of its upper end and projecting upward therefrom for engaging the closure to be formed by the removal of the breakable portion, the upward projection of the engaging member extending along the lower end of the closure forming portion on the inner side thereof.

When the breakable portion is torn off, the sealed paper container is converted to a container having a closure and an opening corresponding to its cross section in size. Accordingly, ice cream or the like, pastes and even solids which can not be contained in the conventional container can be filled in the present container, which is therefore not limited to use for liquid contents. Consequently, the container will find much wider use. After some contents are taken out of the container, the opening can be closed with the closure. Since the closure itself is formed by a portion of the sealed container and is not made specifically, the container is advantageous with respect of cost.

The present invention will be described in greater detail with reference to the accompanying drawings.

DESCRIPTION OF THE PREFERRED EMBODIMENT

Figure 1:
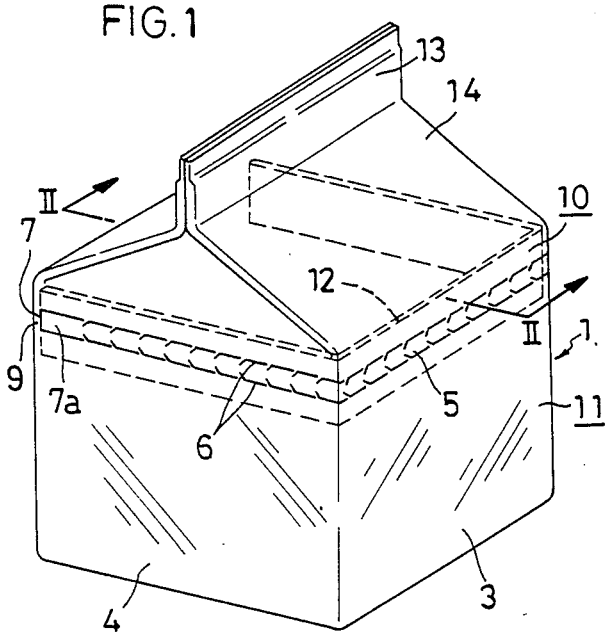
FIG. 1 is a perspective view showing a sealed paper container embodying the invention.
Figure 3:
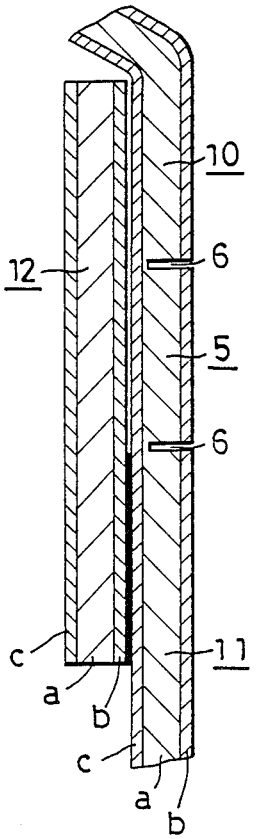
FIG. 3 is an enlarged view in section showing the portion A in FIG. 2.
Figure 2:
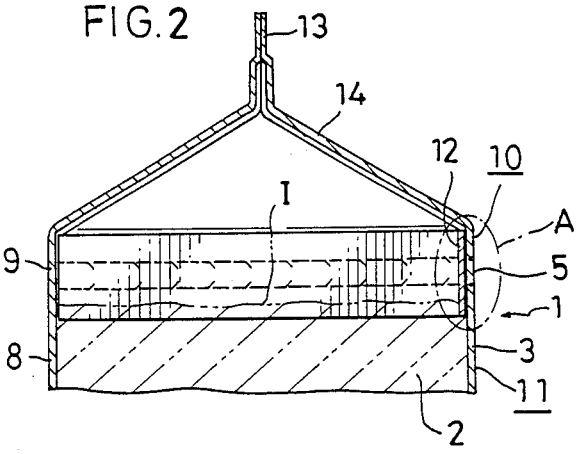
FIG. 2 is a fragmentary view in section taken along the line II—II in FIG. 1.

With reference to FIGS. 1 and 2, a sealed paper container 1 filled with ice cream I has a trunk of square to rectangular cross section. The trunk has three side walls 2, 3, 4 which are formed with a horizontal breakable portion 5 positioned close to their upper ends and removable by tearing by hand. The breakable portion 5 is formed by upper and lower incisions 6 arranged discretely in a multiplicity of pairs and a laterally U-shaped incision 7 disposed at one end of the arrangement. The inside portion of the U-shaped incision 7 provides a knob 7*a* for use in tearing off the portion 5. As seen in FIG. 3, the container 1 is made of paper a provided with thermoplasic resin layers b and c covering its opposite surfaces. The incisions 6 and 7 are formed in the wall of the container from outside close to the inner synthetic resin layer c without extending through the paper a. If the contents are such that they will not penetrate into the paper layer, the incisions 6 and 7 may be formed in the inner side of the container 1. In this case, however, the knob end of the breakable portion must be made apparent when seen and also made holdable by hand for tearing. The remaining side wall 8 of the trunk is provided at the same level as the breakable portion 5 with a portion 9 for forming a joint between the container body and the closure to be formed by the removal of the breakable portion 5. The breakable portion 5 and the joint forming portion 9 serve as a boundary to provide a closure forming portion 10 thereabove and a container body forming portion 11 therebelow. The container body forming portion 11 has an engaging member 12 in the form of a continuous strip, extending along the three side walls 2, 3, 4, secured to the inner side of the upper end of the portion 11 and projecting upward therefrom for engaging the closure to be formed by the removal of the breakable portion 5. Like the container 1, the engaging member 12 is made of paper having a thermoplastic synthetic resin layer covering each surface of the paper. Depending on the contents to be filled in the container 1, the container may be made of a paper-base composite material comprising five layers of thermoplastic synthetic resin, paper, thermoplastic synthetic resin, aluminum foil and thermoplastic synthetic resin, as arranged from outside inward. Polyethylene is generally used as the thermoplastic synthetic resin.

As is well known, the sealed paper container 1 is of the type having a gabled roof 14 with an upright portion 13 formed at its top. Accordingly, the closure forming portion 10 includes this roof 14. Of course, the container can be in the form of a rectangular parallelepiped in its entirety without such a roof.

Figure 4:
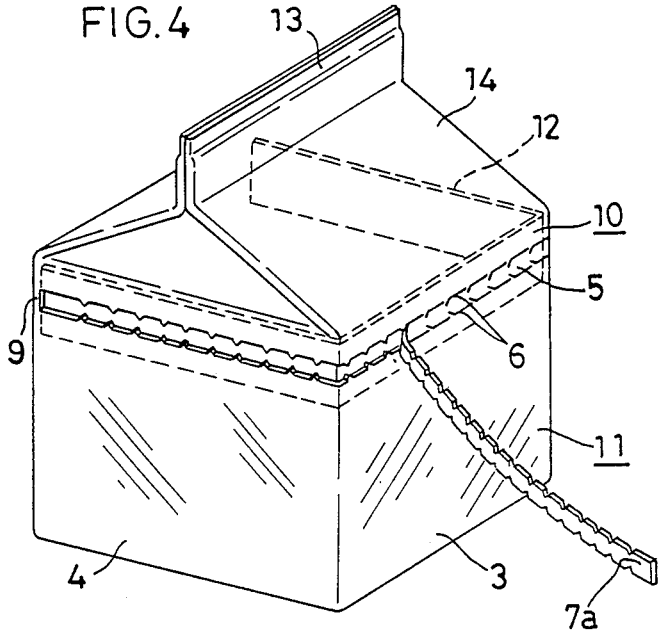
FIG. 4 is a perspective view showing the container while it is being torn.
Figure 5:
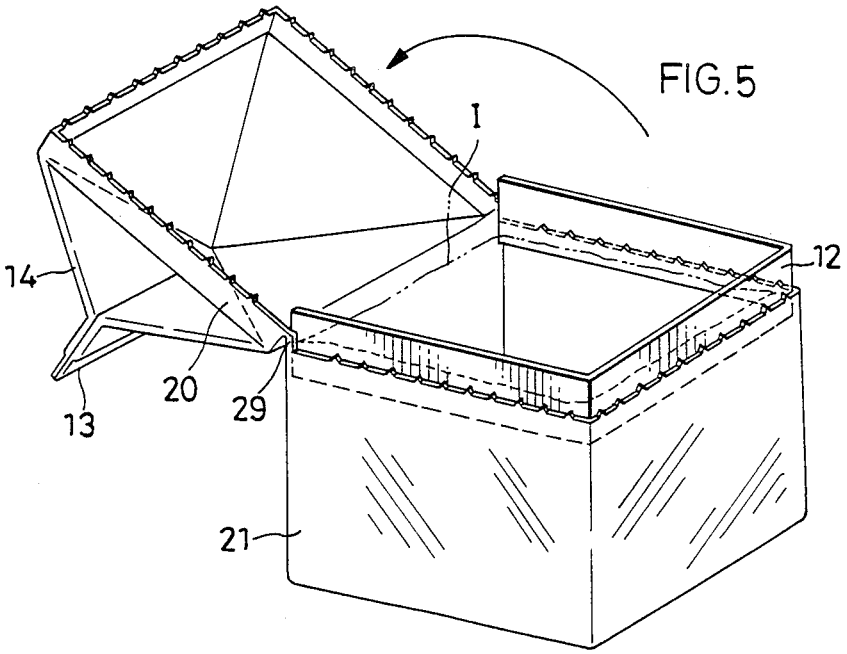
FIG. 5 is a perspective view showing the container as converted to a container with a closure.

To open the container 1, the breakable portion 5 is pulled by the knob 7*a* to tear the third side wall 4 first, then the second side wall 3 and thereafter the first side wall 2 as seen in FIG. 4 to separate these side walls into upper and lower portions. When the portion 5 has been completely removed as seen in FIG. 5, the closure forming portion 10 makes a closure 20, the container body forming portion 11 makes a container body 21, and the joint forming portion 9 makes a joint 29. Since the closure 20 has the upright portion 13 according to the present embodiment, the closure 20 is opened as turned about the joint 29. The contents of the container body 21, i.e. ice cream I, can then be eaten.

If some ice cream I remains in the container body 21, the closure 20 is returned to the initial position. The closure 20 is held closed by the engaging member 12. The incisions arranged discretely are not limited to the illustrated form insofar as the three side walls can be torn continuously by pulling one end of the breakable portion. The incisions need not always be in a discrete arrangement but can be continuous.

The engaging member 12 need not always extend continuously along the three side walls 2 to 4 as shown but can be provided, for example, only at the corners of the side walls 2 to 4. Thus, at least one engaging member may be provided at a location where the closure 20 can be thereby held closed.

The contents to be filled in the sealed paper container are not limited to ice cream but can be miso or like pastes, and solids which can be contained therein. Of course, liquids can be filled in the container.

What is claimed is:

1. A sealed paper container, comprising:

a container defined by a container body forming portion and a closure forming portion, said container having inner and outer opposite surfaces each provided with a thermoplastic synthetic resin coating layer, said container having a trunk of rectangular cross section, said trunk having four side walls with a horizontal breakable portion formed in three of said side walls close to an upper end of each and removable by tearing by hand, a remaining fourth side wall of the trunk being provided at the same level as the breakable portion with a joint forming portion positioned between said container body forming portion and said closure forming portion and formed by the removal of the breakable portion, said breakable portion and said joint forming portion serving as a boundary between said closure forming portion thereabove and said container body forming portion therebelow, said closure forming portion having a gabled roof with an upright portion formed at an upper end of said gabled roof, said container body forming portion having an engaging member secured to an inner side of its upper end, said engaging member having a projection extending upward for engaging with said closure forming portion to be exposed upon opening the container by the removal of the breakable portion, said upward projection of said engaging member extending along a lower end of said closure forming portion along an inner side thereof, said breakable portion being formed by upper and lower incisions arranged in a multiplicity of pairs discretely, said incisions being formed from outside the container and extending close to the inner thermoplastic synthetic resin layer.

2. A sealed paper container according to claim 1, wherein the container is made of a paper-based composite material having an aluminum foil layer interposed between a paper layer and said inner thermoplastic synthetic resin layer.

3. A sealed paper container according to claim 1, wherein the thermoplastic synthetic resin is polyethylene.

* * * * *